US005590573A

United States Patent [19]

Detable

[11] Patent Number: 5,590,573

[45] Date of Patent: Jan. 7, 1997

[54] PAIR OF JAW FITTINGS FOR MOUNTING ON PLIERS FOR CLAMPING A COLLAR

[75] Inventor: Pascal Detable, Gievres, France

[73] Assignee: Etablissements Caillau, Issy-Les-Moulineaux, France

[21] Appl. No.: 414,344

[22] Filed: Mar. 31, 1995

[30] Foreign Application Priority Data

Apr. 12, 1994 [FR] France ..... 94 04296

[51] Int. Cl.[6] ..... B25B 27/10

[52] U.S. Cl. ..... 81/9.3; 81/423; 81/426

[58] Field of Search ..... 81/9.3, 422, 423, 81/426, 426.5

[56] References Cited

FOREIGN PATENT DOCUMENTS 2916474 10/1980 Germany .
9216463 1/1993 Germany .

*Primary Examiner*—James G. Smith
*Attorney, Agent, or Firm*—Marshall & Melhorn

[57] ABSTRACT

A pair of jaw fittings for mounting on the jaws of a pair of pliers for clamping a collar having two radially projecting tabs. The front faces of the jaws which come into abutment with the tabs include respective recessed housings each having an end wall, a bottom wall, and a top wall. The end wall of the housing in the second fitting is substantially plane. The end wall of the housing in the first fitting includes a substantially plane middle setback which leaves two lateral portions remaining that are parallel to said setback.

4 Claims, 5 Drawing Sheets

PAIR OF JAW FITTINGS FOR MOUNTING ON PLIERS FOR CLAMPING A COLLAR

FIELD OF THE INVENTION

Numerous types of collar are known for clamping a flexible hose on a rigid tube. To install such collars, it is common practice to use a clamping tool of the pliers kind.

The present invention relates specifically to a pair of fittings for mounting on the jaws of pliers for clamping a collar, itself constituted by a rolled-up metal strip, having two end portions each provided with a respective tab that extends substantially radially outwards from the collar.

Each fitting in the pair comprises means for fixing to a respective jaw of the pliers and has a front face designed to co-operate with a respective one of said tabs of the collar by coming into abutment therewith. Each of the front faces of the fittings has a recessed housing comprising an end wall and, on either side thereof, a bottom wall and a top wall that project from the end wall.

The recessed housing of a "second" one of the fittings is disposed transversely in the middle portion of the front face of said fitting, and includes an end wall that is substantially plane.

The collar that is to be clamped may be a spring collar whose metal strip is rolled up through more than 360°, such that the operation of "clamping" the collar consists, in fact, of urging the tabs on the terminal portions of the strip towards each other by means of a pliers-type clamping tool. The diameter of the collar is thus increased, thereby making it possible to slide it axially onto the hose or other object to be clamped. By relaxing the force urging the tabs toward each other, the energy stored in the collar is released so that the collar naturally tightness onto the hose as it attempts to return to its initial diameter.

BACKGROUND OF THE INVENTION

Such spring collars are known, in particular, from two French patent applications filed by the Applicant on Feb. 26, 1993 and having respective titles [in translation] "Spring clamping collar" and "Spring clamping collar with improved safety", and also from French patent FR 2 495 265.

The first two of those documents disclose a first type of spring collar in which the tabs extend transversely over the entire width of the strip.

The third document describes a second type of spring collar in which the first terminal portion of the strip is provided with a central slot and has a wide tab, while the second terminal portion has a narrow tab that passes through the central slot.

Thus, the tabs are of different widths depending on which particular type of collar is concerned.

Until now, it has therefore been necessary to use special fittings or indeed special pliers as a function of the kind of collar to be clamped.

Thus, even in a single application, changing from one type of collar to the other has made it necessary either to change pliers, thereby making it necessary to acquire numerous types of tool and thus giving rise to excessive costs, or else while continuing to use the same basic pair of pliers, to remove a first pair of jaw fittings adapted to one type of collar and replace them with a second pair of jaw fittings adapted to the other type of collar.

Although using jaw fittings of two types is cheaper than using pliers of two types, it nevertheless requires pairs of jaw fittings of different types to be acquired and gives rise to considerable losses of time that reduce assembly rates. In addition, the fittings, and in particular their elements for fixing them on the jaws of a pair of pliers, such as spring clips, are parts that are relatively small, and that can therefore be awkward to handle and that are easily mislaid.

OBJECTS AND SUMMARY OF THE INVENTION

An object of the present invention is to remedy the above drawbacks and provide a multipurpose pair of jaw fittings suitable for being mounted on the jaws of pliers and adapted to clamping collars of both known types.

To this end, a "second" one of the jaw fittings is of the above-specified type, while the recessed housing of the other or "first" fitting is disposed transversely in the middle portion of the front face of said fitting, and the end wall of said recessed housing includes a substantially plane middle setback that leaves two substantially plane lateral portions remaining in said end wall, parallel to said setback and disposed on either side thereof.

By means of this configuration, the pair of jaw fittings is adapted to clamping spring collars of the various known types mentioned above.

Depending on circumstances, one of the tabs of a collar comes into abutment with the two lateral portions of the recessed housing of the first fitting or with the middle setback of said recessed housing, while the substantially plane end wall of the recessed housing of the second fitting continues to be adapted to receive the other tab in abutment.

The width or transverse dimension of the various collar elements is defined in opposition to the longitudinal direction of the strips that constitute the collars. By analogy, the transverse dimensions of the various elements of one or the other of the fittings extend parallel to the transverse dimensions of the tabs of the collars when the collars are engaged in the housings of said fittings.

BRIEF DESCRIPTION OF THE DRAWINGS

The invention will be better understood and its advantages will appear more clearly on reading the following detailed description of an embodiment that is shown by way of non-liming example. The description refers to the accompanying drawings, in which.

MORE DETAILED DESCRIPTION

Figure 1:
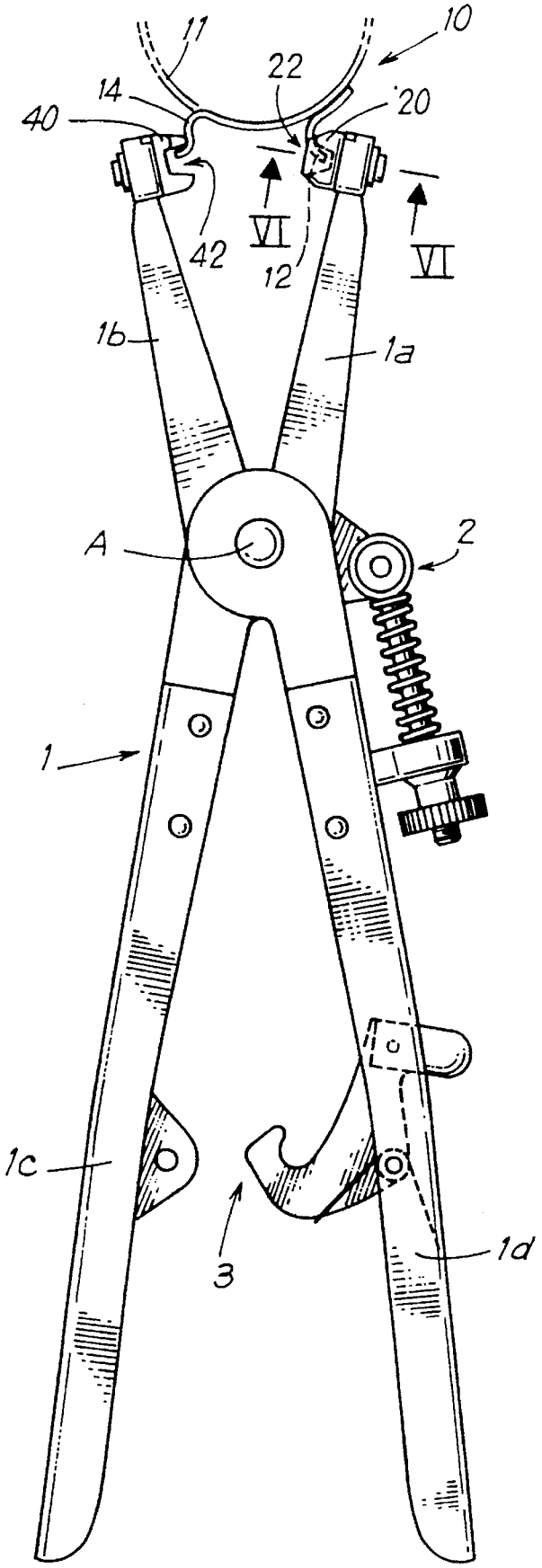
FIG. 1 is an elevation view of a pair of pliers fitted with a pair of jaw fittings of the invention, and shown while clamping a spring collar.

FIG. 1 shows a conventional pair of pliers 1 comprising, pivotally mounted about an axis A, two clamping jaws 1*a* and 1*b* and two handles 1*c* and 1*d*. The axis of the handles 1*c* and 1*d* is perpendicular to the pivot axis A. In known manner, the pliers 1 include a device 2 for adjusting the minimum separation between the clamping jaws, and a device 3 for retaining them in the closed position.

The pair of pliers 1 is a tool for clamping a collar 10 which is constituted by a rolled-up metal strip 11 having two end portions provided with respective tabs 12 and 14 that extend substantially radially outwards from the collar 10.

Figure 2:
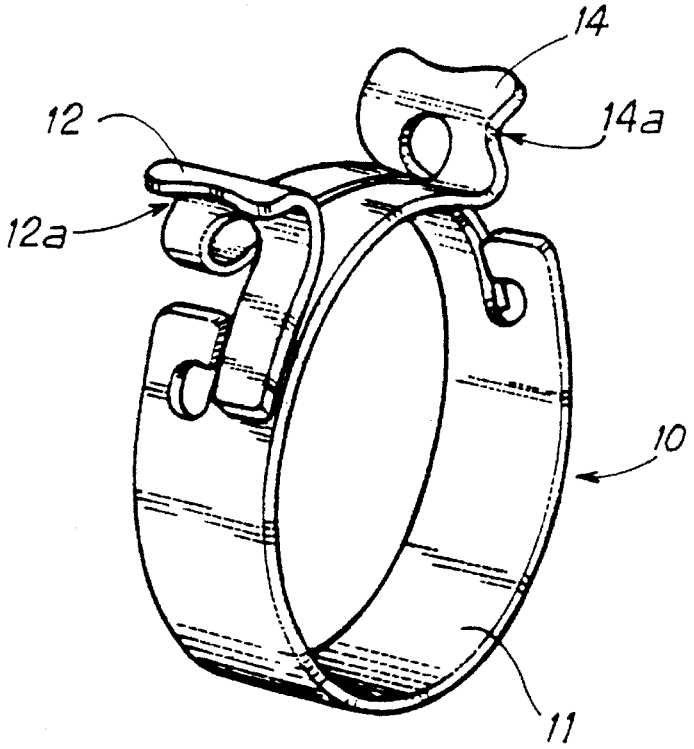
FIG. 2 is a perspective view of a first type of spring collar.

The collar shown diagrammatically in FIG. 1 is of the type shown in FIG. 2.

In order to clamp the collar 10, two jaw fittings 20 and 40 constituting a pair are mounted on the clamping jaws of the pliers 1.

The first fitting 20 is mounted on jaw la and has a front face 22 which comes into abutment with tab 12 of the collar. Similarly, the second fitting 40 is mounted on jaw 1*b* and has a front face 42 which comes into abutment with the tab 14 of the collar.

When the fittings are mounted on the jaws of the pliers, their front faces face each other, and their rear faces face away from each other. Therefore, when the pliers are tightened together, the front faces of the two jaw fittings are moved towards each other.

Still with the fittings mounted on the jaws, the bottom portions of the fittings are closer to the pivot axis A of the jaws of the pliers, whereas their top portions are further away from said axis A.

Figure 4A:
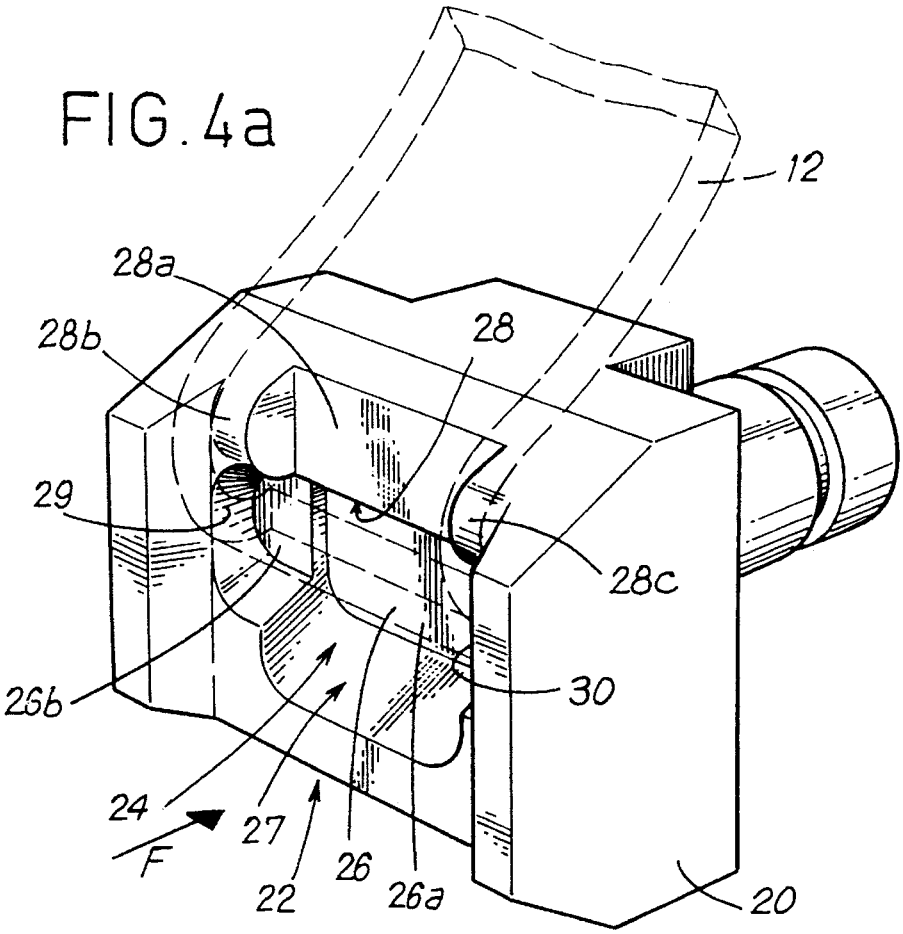
FIGS. 4*a* and 4*b* are perspective views showing the first and second jaw fittings respectively of a pair of fittings when their front faces are co-operating with the two tabs of a FIG. 2 type collar.
Figure 4B:
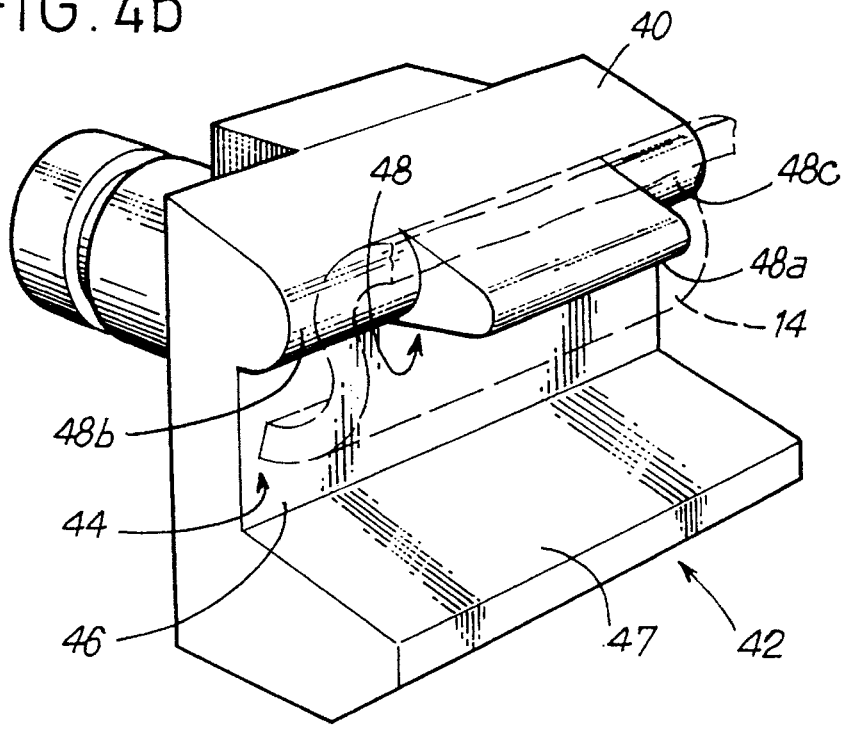

As shown in FIG. 4*b*, the second jaw fitting 40 has a front face 42 that includes a recessed housing 44 including an end wall 46, a bottom wall 47, and a top wall 48. The recessed housing 44 extends transversely of the handle axis across the middle portion of the front face 42 of the fitting 40, and its end wall 46 is substantially plane.

With reference to FIG. 4*a*, it can be seen that the first jaw fitting 20 has a front face 22 which itself has a recessed housing 24 including an end wall 26, a bottom wall 27, and a top wall 28.

The housing 24 extends transversely of the handle axis in the middle portion of the front face 22 of the first fitting 20. The end wall 26 of the housing 24 includes a middle setback 26*a* that is substantially plane, and that leaves two substantially plane lateral portions 26*b* and 26*c* parallel to the setback 26*a* and disposed on either side thereof.

Reference 28 designates the top wall of the housing 24 which is constituted by the bottom face of a projection projecting from the front face 22 of the fitting 20. For reasons made clear below, the wall 28 advantageously includes a notch 28*a* of transverse size substantially equal to that of the middle setback 26*a*. Thus, the projection that projects from the front face 22 is constituted solely by two projecting lateral surfaces 28*b* and 28*c* that are disposed on either side of the notch 28 and that are situated transversely substantially opposite the lateral portions 26*b* and 26*c* of the end wall of the housing 24; their transverse size is substantially equal to the side of each of the lateral portions 26*b* and 26*c*.

The first fitting 20 is symmetrical about an axis Y (FIG. 7) that is perpendicular to its transverse direction. The axis Y is substantially coincident with the handle axis. The same also applies to the second fitting 40.

As can be seen in FIG. 2, the two tabs 12 and 14 of the collar 10 are of the same width, which width is substantially equal to the width of the strip 11.

Figure 3:
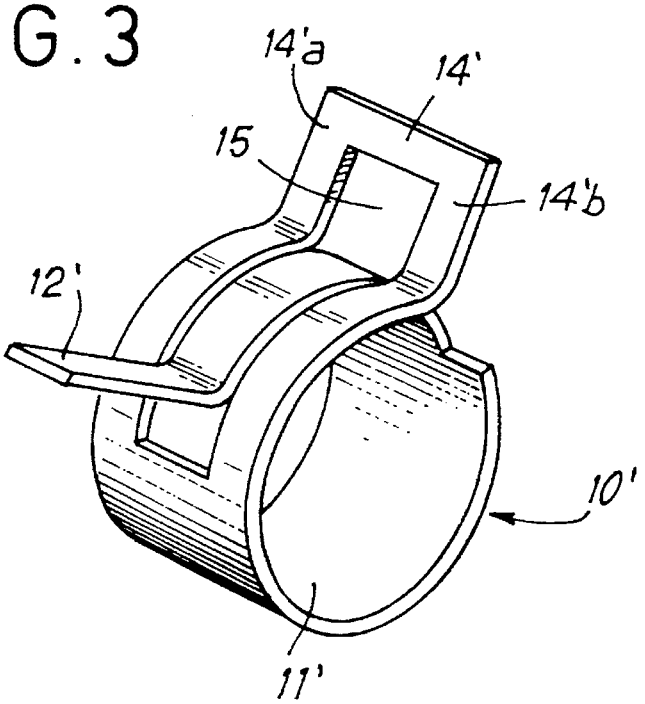
FIG. 3 is a perspective view of a second type of spring collar.

In contrast, the two tabs 12' and 14' of the collar 10' shown in FIG. 3 are of different widths. One of the end portions of the rolled-up strip 11' has a wide tab 14' and a central slot 15. The other tab 12' is referred to as the "narrow" tab and is carried by a portion of the strip that passes through said slot 15 and which is of a width that is substantially equal to the width of the slot.

As shown in FIGS. 4*a* and 4*b*, the jaw fittings 20 and 40 are adapted for clamping the collar 10 shown in FIG. 2. The tab 12 of said collar comes into abutment with the two lateral portions 26*b* and 26*c* of the end wall 26 of the recessed housing 24 in the first fitting 20 while bearing, if necessary, against the two lateral surfaces 28*b* and 28*c*, while the tab 14 comes into abutment against the end wall 46 of the recessed housing 44 of the second fitting 40.

It should be observed that the collar 10 is symmetrical about a diameter and that the two fittings 20 and 40 adapt equally well to either of the two tabs 12 and 14.

As can be seen in FIG. 4*a*, the lateral surfaces 28*b* and 28*c* on either side of the notch 28*a* co-operate with the rear face of the tab 12 of the collar 10 while the collar is being clamped.

To improve co-operation between the tabs 12 or 14 of the collar 10 and the first fitting 20, it is advantageous for the projecting lateral surfaces 28*b* and 28*c* to be of a convex shape towards their foremost portions that matches the curvature of the rear face 12*a* or 12*b* of the tabs.

In order to hold the tab 14 laterally in place, the housing 24 of the first fitting 20 advantageously includes two lateral walls 29 and 30.

Figure 7:
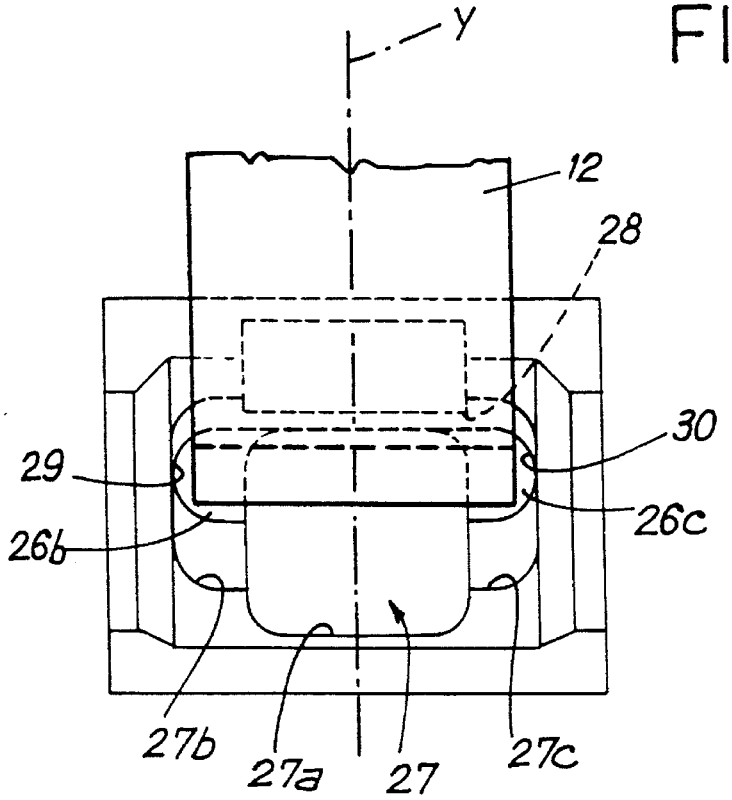
FIG. 7 shows the first fitting as seen looking arrow F in FIG. 4*a*.

As can be seen better in FIG. 7, the lateral walls 29 and 30 are situated transversely beyond the lateral portions 26*b* and 26*c* of the end wall 26 of said housing, and they are spaced apart substantially by the width of the tabs of a collar of the first type under consideration.

Figure 5A:
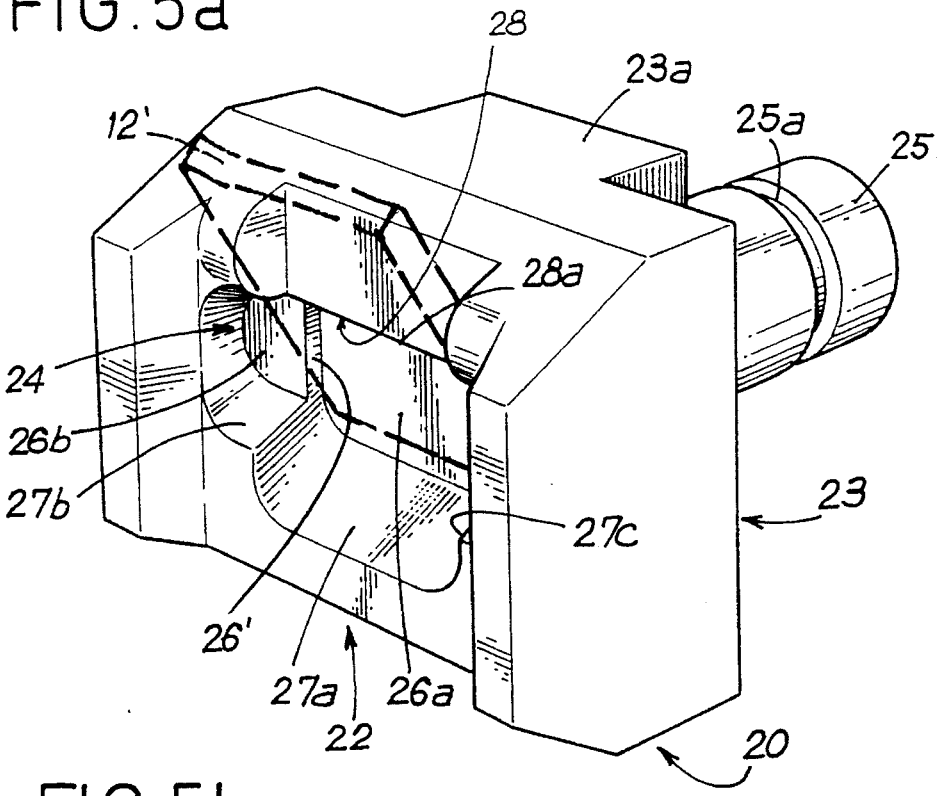
FIGS. 5*a* and 5*b* are identical to FIGS. 4*a* and 4*b*, except that they show the front faces of the jaw fittings co-operating with the two tabs of a FIG. 3 type collar.
Figure 5B:
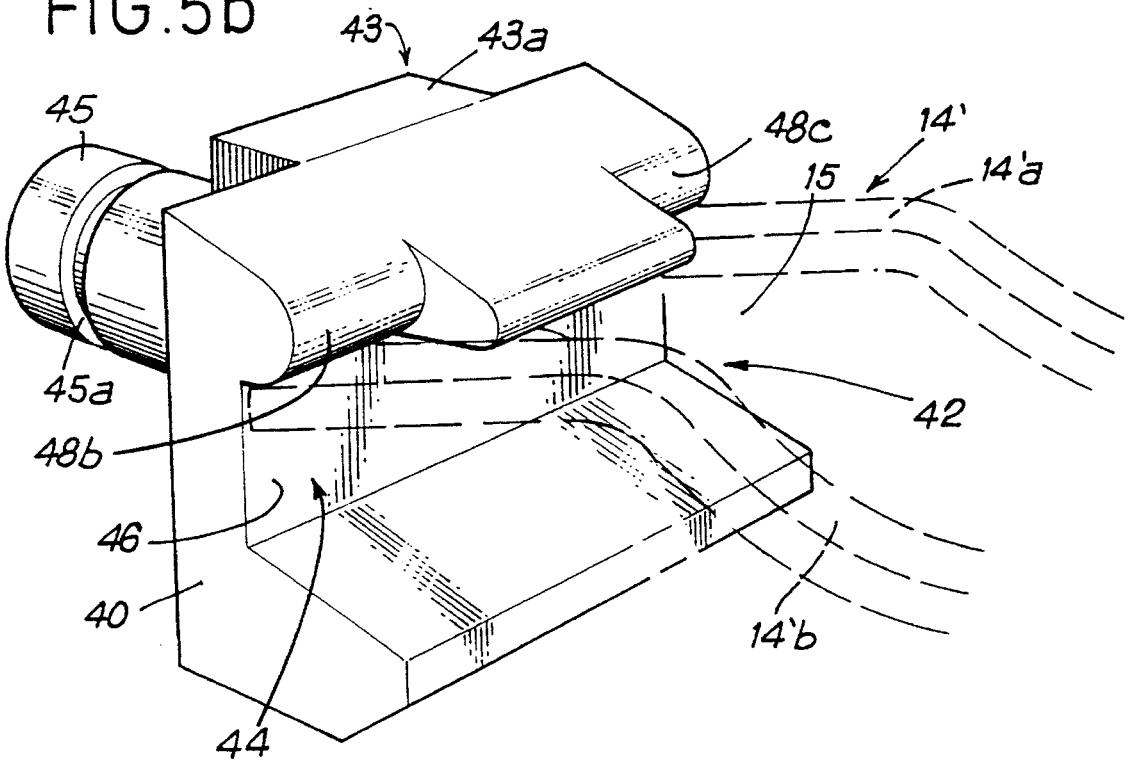

As can be seen in FIGS. 5*a* and 5*b*, the fittings 20 and 40 are also adapted to clamping the collar 10'. The narrow tab 12' of this collar comes into abutment with the middle setback 26*a* of the end wall 26 of the recessed housing 24 of the first fitting 20, while the wide tab 14' comes into abutment with the end wall 46 of the housing 44 of the second fitting 40.

With reference to FIG. 5*a*, which shows the first fitting 20, it can be seen that the transition zone between the middle setback 26*a* and each of the two lateral portions 26*b* and 26*c* is constituted by a step 26' which, during clamping of the collar 10', contributes to holding the collar in place laterally by means of its narrow tab 12'.

During clamping, each of the two tabs 12' and 14' slopes so that the angle it forms with the end wall of the housing of the corresponding fitting decreases.

As shown in FIG. 5*a*, the notch 28*a* serves to prevent the top wall 28 of the housing 24 constituting an obstacle to the pivoting motion of the narrow tab 12'.

To contribute also to securing the wide tab 14' of the collar 10', the top wall 48 of the housing 44 of the second fitting 40 advantageously has a middle extension 48*a* whose transverse size is substantially equal to that of the middle setback 26*a* and of the notch 28*a* of the housing in the first fitting.

As mentioned before, when the collar 10' is clamped, the angle between each of its tabs and the end walls of the housings in the fittings decreases. During this movement, the middle extension 48*a* engages at least in part in the central slot 15 of the wide tab 14', thereby eliminating or at least reducing any lateral play of said tab.

On either side of the middle extension 48*a*, there are two setback lateral surfaces 48*b* and 48*c*. When the collar 10' is about to be clamped, then each of these two setback surfaces co-operates with a corresponding one of the two portions 14'*a* and 14'*b* of the wide tab 14' that are situated on either side of the slot 15.

When the collar 10 is to be clamped under the conditions mentioned above, then the extension 48*a*, and more precisely its foremost portion, can co-operate with the rear face 14*a* of the tab 14. In order to improve such co-operation, the front end portion of the middle extension 48*a* may be convex in shape to match the curvature of the rear face 14*a* of said tab 14.

Finally, it should be mentioned that the top and bottom walls of the housings 24 and 44 are advantageously inclined at an angle of more than 90° relative to the end walls of said housings.

Similarly, the bottom wall 27 of the housing 24 in the first fitting 20 advantageously has a middle offset portion 27*a* of width substantially equal to that of the middle setback 26*a*. Two lateral portions 27*b* and 27*c* of said bottom wall 27 remain on either side of the middle offset portion 27*a* (FIG. 5*a*). Co-operation between the end of the narrow tab 12' of the collar 10' and the middle offset portion 27*a* determines the extreme downwards position for said tab during clamping of the collar.

Figure 6:
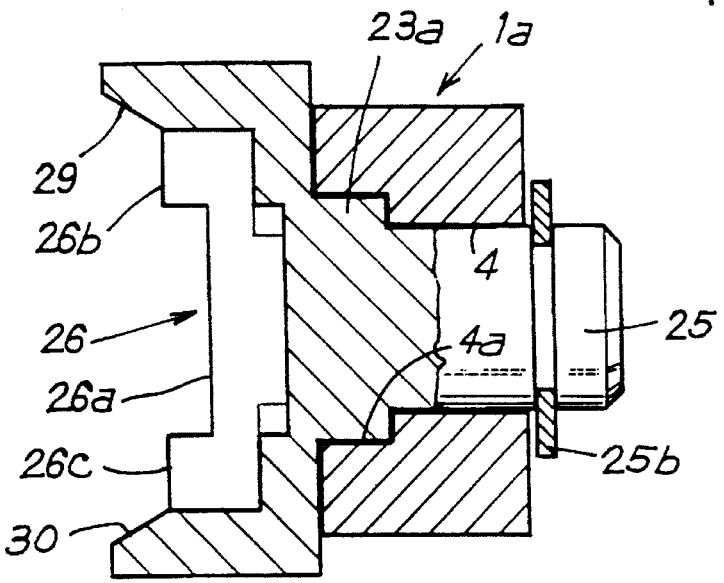
FIG. 6 is a section through the first fitting on line VI—VI of FIG. 1.

As can be seen in particular in FIG. 6, which applies to the first fitting 20, and as can be seen in FIGS. 4*b* and 5*b* for the second fitting, each jaw fitting 20 or 40 is fixed to the corresponding clamping jaw 1*a* or 1*b* of the pliers 1 by fixing means comprising a stud 25 or 45 that projects from the rear face 23 or 43 of the corresponding fitting. The stud engages in an opening 4 of the corresponding clamping jaw of the pliers. It includes a circular groove 25*a* or 45*a* in which a spring clip 25*b* is received so as to hold the fitting in the installed position.

Each of the fittings is prevented from rotating by means of a projection 23*a* or 43*a* on its rear face 23 or 43 that co-operates with a recess 4*a* of complementary shape in the corresponding jaw of the pliers.

I claim:

1. A pair of jaw fittings for mounting on the jaws of a pair of pliers for clamping a collar, said collar being constituted by a rolled-up metal strip and having two terminal portions each provided with a respective tab extending substantially radially outwards from the collar, each fitting in the pair having fixing means for fixing it to one of the jaws of the pliers and having a front face designed to come into abutment with one of said tabs of the collar, each of the front faces of the fittings have a recessed housing including an end wall, and a bottom wall and a top wall, that project from said end wall, with the recessed housing of a "second" one of the fittings extending transversely to a handle axis in a middle portion of the front face of said fitting and including a substantially plane end wall, wherein the recessed housing of the other or "first" fitting is disposed transversely to a handle axis in a middle portion of the front face of said fitting and wherein the end wall of said recessed housing includes a substantially plane middle setback that leaves two substantially plane lateral portions remaining in said end wall, parallel to said setback and disposed on either side thereof.

2. A pair of jaw fittings according to claim 1, wherein the top wall of the recessed housing of the first fitting has a middle notch whose transverse size is substantially equal to that of the middle setback of the end wall of said housing, said notch causing two projecting lateral surfaces to appear in said top wall on either side of said notch, the transverse size of each of said lateral surfaces being substantially equal to the transverse size of each of the lateral portions of the end wall of said housing.

3. A pair of jaw fittings according to claim 1, wherein the recessed housing of the first fitting includes two lateral walls situated transversely beyond the lateral portions of the end wall of said housing.

4. A pair of jaw fittings according to claim 2, wherein the projecting lateral surfaces of the top wall of the housing of the first fitting are convex towards their front end portions.

* * * * *